US008317461B2

(12) United States Patent
Tholen et al.

(10) Patent No.: US 8,317,461 B2
(45) Date of Patent: Nov. 27, 2012

(54) GAS TURBINE ENGINE COMPONENT HAVING DUAL FLOW PASSAGE COOLING CHAMBER FORMED BY SINGLE CORE

(75) Inventors: Susan Tholen, Kennebunk, ME (US); Paul M. Luljen, Kennebunkport, ME (US)

(73) Assignee: United Technologies Corporation, Hartford, CT (US)

( * ) Notice: Subject to any disclaimer, the term of this patent is extended or adjusted under 35 U.S.C. 154(b) by 1127 days.

(21) Appl. No.: 12/198,917

(22) Filed: Aug. 27, 2008

(65) Prior Publication Data

US 2010/0054914 A1 Mar. 4, 2010

(51) Int. Cl.
*F01D 5/14* (2006.01)

(52) U.S. Cl. ..... 415/115; 415/116; 415/173.1; 415/173.2

(58) Field of Classification Search ..... 415/115–116, 415/173.1, 173.2, 175–178
See application file for complete search history.

(56) References Cited

U.S. PATENT DOCUMENTS

| | | | | |
|---|---|---|---|---|
| 4,466,772 | A | 8/1984 | Okapuu et al. | |
| 4,474,532 | A | 10/1984 | Pazder | |
| 4,981,018 | A | 1/1991 | Jones et al. | |
| 5,333,992 | A | 8/1994 | Kane et al. | |
| 5,374,161 | A | 12/1994 | Kelch et al. | |
| 5,375,973 | A | 12/1994 | Sloop et al. | |
| 5,462,405 | A | 10/1995 | Hoff et al. | |
| 5,486,090 | A | 1/1996 | Thompson et al. | |
| 5,538,393 | A | 7/1996 | Thompson et al. | |
| 5,609,469 | A | 3/1997 | Worley et al. | |
| 5,669,759 | A | 9/1997 | Beabout | |
| 6,152,695 | A | 11/2000 | Fukue et al. | |
| 6,155,778 | A | 12/2000 | Lee et al. | |
| 6,247,896 | B1 | 6/2001 | Auxier et al. | |
| 6,254,333 | B1 | 7/2001 | Merry | |
| 6,280,140 | B1 | 8/2001 | Soechting et al. | |
| 6,340,284 | B1 | 1/2002 | Beeck et al. | |
| 6,637,500 | B2 | 10/2003 | Shah et al. | |
| 6,890,154 | B2 | 5/2005 | Cunha | |
| 6,929,054 | B2 | 8/2005 | Beals et al. | |
| 6,932,571 | B2 | 8/2005 | Cunha et al. | |
| 7,097,424 | B2 | 8/2006 | Cunha et al. | |
| 7,108,045 | B2 | 9/2006 | Wiedemer et al. | |
| 7,246,993 | B2 | 7/2007 | Bolms et al. | |
| 7,303,375 | B2 | 12/2007 | Cunha et al. | |
| 2006/0140753 | A1* | 6/2006 | Romanov et al. | 415/173.1 |
| 2007/0020087 | A1* | 1/2007 | Durocher et al. | 415/115 |
| 2007/0048128 | A1 | 3/2007 | Cunha et al. | |

FOREIGN PATENT DOCUMENTS

| | | |
|---|---|---|
| EP | 0927814 | 8/2004 |

* cited by examiner

*Primary Examiner* — Ajay K Arora
(74) *Attorney, Agent, or Firm* — Carlson, Gaskey & Olds, PC

(57) ABSTRACT

A blade outer air seal for being positioned radially outwardly of a gas turbine blade has at least one cooling air passage with a dividing wall dividing the at least one cooling air passage into two separate flow paths. The dividing wall does not extend throughout an entire length of the blade outer air seal of the first dimension.

1 Claim, 1 Drawing Sheet

GAS TURBINE ENGINE COMPONENT HAVING DUAL FLOW PASSAGE COOLING CHAMBER FORMED BY SINGLE CORE

This invention was made with government support under Contract No. N00019-02-C-3003 awarded by the United States Navy. The Government may therefore have certain rights in this invention.

BACKGROUND OF THE INVENTION

This application relates to a gas turbine engine component wherein an internal cooling air passage is divided into two separate paths, and wherein the two separate paths are formed from a single core in a lost core molding process.

Gas turbine engines are known and typically include a compressor section compressing air and delivering it into a combustion section. The air is mixed with fuel in the combustion section and ignited. Products of the combustion pass downstream over turbine rotors, driving the turbine rotors.

There is a good deal of design that goes into the structure of the turbine rotors, and a number of components that are utilized to control the flow of the products of combustion such that they are directed along desired flow paths. One such component is called a blade outer air seal. A blade outer air seal sits slightly radially outwardly of an outer tip of a turbine blade in a turbine rotor, which is driven to rotate by the products of combustion. By having the blade outer air seal closely spaced from the rotor, leakage of the products of combustion around the turbine rotor is reduced.

The blade outer air seals are subject to very high temperature. Thus, it is known to provide cooling air through the blade outer air seal.

Cooling air from a source of air cooler than the product of combustion is circulated through channels in the blade outer air seal. Recently, these channels have become thinner in a radial dimension. It is known that as the channels become thinner relative to an axial width of the channel, the flow characteristics of the cooling air may degrade. That is, when an aspect ratio of a circumferentially-flowing channel (where the aspect ratio is the radial dimension divided by the axial dimension), is relatively high, then there is good circulation of air and desirable heat transfer characteristics. On the other hand, as the aspect ratio drops, which occurs as the (radial) height of the channel becomes smaller, the heat transfer effectiveness may decrease and/or friction losses may increase. Having a thinner radial dimension is desirable to enable higher cooling effectiveness for the same amount of air flow, or achieving the same cooling effectiveness with reduced air flow. The usage of bleed air for cooling parts rather than producing thrust causes a reduction in turbine efficiency.

Thus, it is known in the prior art to form two separate channels where there was one when there is a relatively radially thin cooling air passage.

Such components are typically formed by lost core molding processes. In a lost core molding process, a core is created for all hollow spaces that are to be formed in the blade outer air seal. Thus, a core would be formed to form the cooling air passages within the blade outer air seal. The core is inserted into a mold, and metal is molded around the core. The core may then be leached away leaving a hollow within the blade outer air seal. The prior art solution of providing two separate channels requires two separate cores, and is thus somewhat undesirable.

In addition, with two separate cores there must be two separate inlet and exit holes. The use of two separate inlet and exit holes can result in a reduced total cross-sectional area due to the two allowable tolerances. With the reduced cross-sectional areas, frictional losses can increase. The frictional losses associated with each hole can add undesirably large pressure drops, especially when the radial height is small and there are significant frictional losses along the passage itself.

Also, existing gas turbine engines already have locations for the inlets and the exit holes that must be maintained. Thus, it would not always be possible to add additional inlet and exit holes.

SUMMARY OF THE INVENTION

In a disclosed embodiment of this invention, a gas turbine engine component has a cooling air passage with two distinct flow paths formed by a single core, a single inlet hole, and a single exit hole. The invention also extends to a core and method for forming the component.

In addition, an improved method and an inventive core are also claimed.

These and other features of the present invention can be best understood from the following specification and drawings, the following of which is a brief description.

DETAILED DESCRIPTION OF THE PREFERRED EMBODIMENT

Figure 1:
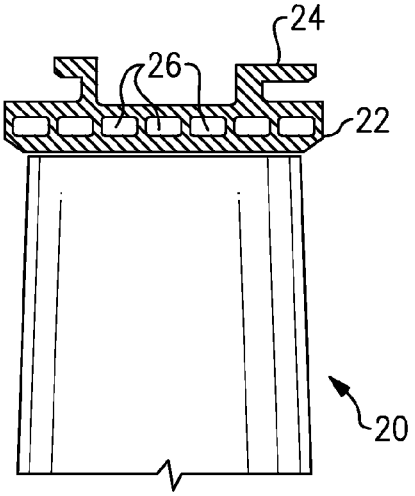
FIG. 1 shows a blade outer air seal.

A gas turbine engine rotor blade 20 is illustrated in FIG. 1. A blade outer air seal 22 has hooks 24 to attach the blade outer air seal into a housing for a gas turbine engine (not shown). Cooling air passages 26 are formed within the body of the blade outer air seal and receive cooling air.

Figure 2:
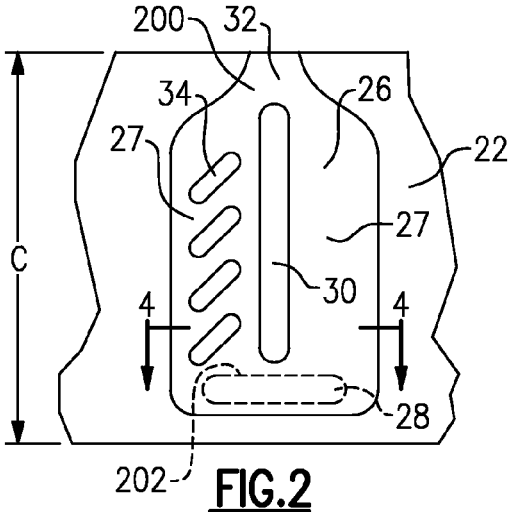
FIG. 2 is a section through an inventive blade outer air seal.

FIG. 2 is a cross-section through one of these cooling air passages 26. As can be seen, there is a central dividing wall 30 that does not extend for an entire circumferential dimension C of the cooling air passage 26. The separating wall 30 effectively divides the channel 26 into two separate passages 27. As shown, an inlet 28 is formed at one end, and extends radially outwardly relative to the FIG. 1 position. In addition, trip strips 34 are shown, and may be utilized to create turbulence in the flow through the passages 27. The outlet 32 depicts an exit where cooling air is delivered to the main hot gas section out of the blade outer air seal 22. The two separate flow paths 27 communicate with a common inlet 28, with flow from the common inlet 28 passing into area 202 and then passing into both of the flow path. The flow paths are then recombined downstream of the dividing wall 200, and pass outwardly of a common outlet 32.

Figure 3:
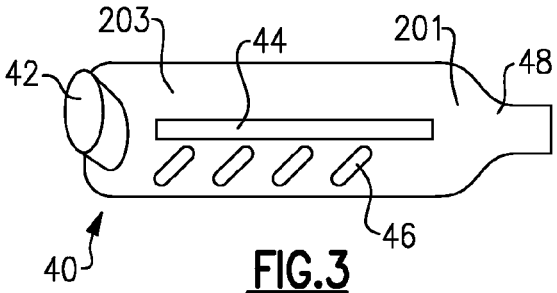
FIG. 3 shows a core.

FIG. 3 shows a core 40 for forming the passage 26. A thumb 42 will form the inlet 28. An outer plug 48 will form the outlet 32. A central hollow 44 extends through the entire width of the core 40 and will form the dividing wall 30. Grooves 46 will form the trip strips 34, as shown. The core 40 forms areas 200 and 202, with solid areas 201 and 202, respectively.

Figure 4:
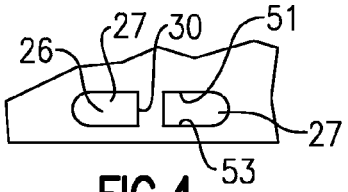
FIG. 4 is a section along line 4-4 of FIG. 2.

Since the slot 44 extends through the entire width, then the dividing wall 30 will extend entirely between upper and lower walls of the passage 26. This can be appreciated from FIG. 4 which is a cross-section through the inventive passage 26 along line 4-4 of FIG. 2. As can be appreciated from FIG. 4, dividing wall 30 extends between an outer wall 51 and an inner wall 53 of the cooling air passage 26.

Figure 5:
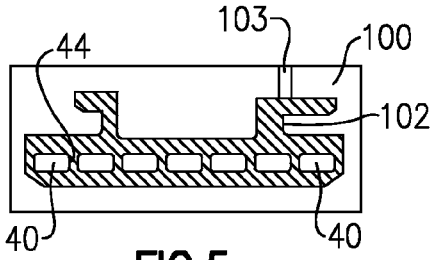
FIG. 5 is a schematic of a mold.

FIG. 5 schematically shows a method of forming the blade outer air seal. As shown, a mold 100 includes a hollow space 102 which will receive molten metal such as through an inlet 103. As shown, a plurality of cores 40 are inserted into the space 102. Metal is injected into the space 102, and is allowed to solidify around the cores 40. At that point, the cores 40 are leached away leaving the structure such as shown in FIG. 2.

The core 40 provides both passages 27 of the channels 26.

The use of the single core to form both passages 27 results in maintaining a single inlet and a single exit hole. Thus, the problem mentioned above of increased frictional losses will not occur. In addition, the method allows the redesign of existing components to achieve smaller radial cross-sections while at the same time maintaining the location of inlet and exit holes.

Although an embodiment of this invention has been disclosed, a worker of ordinary skill in this art would recognize that certain modifications would come within the scope of this invention. For that reason, the following claims should be studied to determine the true scope and content of this invention.

What is claimed is:

1. A blade outer air seal comprising:

a blade outer air seal for being positioned radially outwardly of a gas turbine blade;

said blade outer air seal having at least one cooling air passage extending along a first dimension;

a dividing wall dividing said at least one cooling air passage into two separate flow paths, with said dividing wall extending from a first end on the upstream side to a second end on the downstream side, such that the distance between the first end and the second end is smaller than the entirety of said first dimension;

said dividing wall extending through an entire radial dimension of said at least one cooling air passage, and between inner and outer walls of said at least one cooling air passages;

wherein there are a plurality of said cooling air passages in said blade outer air seal, with each of said plurality of cooling air passages being divided into two separate flow paths; and said two separate flow paths both communicate with a common inlet adjacent the first end, with flow from said common inlet passing into both of said two separate flow paths, and then being recombined downstream of said dividing wall adjacent the second end, and passing outwardly of a common outlet.

* * * * *